US011228079B1

(12) United States Patent
Yu et al.

(10) Patent No.: US 11,228,079 B1
(45) Date of Patent: Jan. 18, 2022

(54) BALUN

(71) Applicant: National Synchrotron Radiation Research Center, Hsinchu (TW)

(72) Inventors: Tsung-Chi Yu, Hsinchu (TW); Chao-En Wang, Hsinchu (TW); Lung-Hai Chang, Hsinchu (TW)

(73) Assignee: NATIONAL SYNCHROTRON RADIATION RESEARCH CENTER, Hsinchu (TW)

( * ) Notice: Subject to any disclaimer, the term of this patent is extended or adjusted under 35 U.S.C. 154(b) by 0 days.

(21) Appl. No.: 17/110,528

(22) Filed: Dec. 3, 2020

(30) Foreign Application Priority Data

Aug. 11, 2020 (TW) ..... 109127258

(51) Int. Cl.
*H01P 5/10* (2006.01)
*H01P 3/08* (2006.01)

(52) U.S. Cl.
CPC ..... *H01P 5/10* (2013.01)

(58) Field of Classification Search
CPC ..... H01P 5/10; H01P 3/08
See application file for complete search history.

(56) References Cited

U.S. PATENT DOCUMENTS 5,025,232 A * 6/1991 Pavio ..... H01P 5/10 333/238
8,154,360 B2 * 4/2012 Uemichi ..... H01P 11/00 333/26
9,692,387 B2 * 6/2017 Simon ..... H03F 1/56
2009/0237175 A1 * 9/2009 Degani ..... H03H 7/42 333/25
2011/0163825 A1 * 7/2011 Urano ..... H01P 5/10 333/26
2014/0022027 A1 * 1/2014 Cammarata ..... H01P 11/00 333/26

FOREIGN PATENT DOCUMENTS

TW 201027833 A1 7/2010

* cited by examiner

*Primary Examiner* — Dean O Takaoka
(74) *Attorney, Agent, or Firm* — Birch, Stewart, Kolasch & Birch, LLP

(57) ABSTRACT

A balun includes a substrate, a balanced port, and an unbalanced port. The balanced port disposed on a first configuration surface of the substrate includes a first metal configuration section, a second metal configuration section, and two balanced terminals respectively disposed at one end of the first metal configuration section and one end of the second metal configuration section. The unbalanced port is disposed on a second configuration surface of the substrate corresponding to an arrangement of the balanced port to form an overlapping coupling with the balanced port. The unbalanced port includes a third metal configuration section and an unbalanced terminal disposed at one end of the third metal configuration section. A first orthographic projection on the substrate formed by the first metal configuration section and the second metal configuration section jointly is overlapped with a second orthographic projection on the substrate formed by the third metal configuration section.

10 Claims, 4 Drawing Sheets

BALUN

CROSS-REFERENCE TO RELATED APPLICATION

This non-provisional application claims priority under 35 U.S.C. § 119(a) to Patent Application No. 109127258 filed in Taiwan, R.O.C. on Aug. 11, 2020, the entire contents of which are hereby incorporated by reference.

BACKGROUND

Technical Field

The present invention relates to a balun, and in particular, to a low-loss balun.

Related Art

A balun may be used for converting a single-ended signal into a differential signal. In applications of radio frequency power, a balun is usually implemented by using a coaxial cable, and a diameter of a coaxial cable used is determined according to an application power. For example, in applications with an application power of 1000 watts (W) or more, a coaxial cable with a diameter of 6 millimeters (mm) or more is generally used. However, a larger diameter of a cable used leads to relatively increased difficulty in all of cutting, bending, and welding of the cable, and increased time and labor costs for production, and this is not conducive to mass production. In addition, in radio frequency power applications, the magnitude of a loss is extremely important. Generally, a common small-signal balun is not suitable for high-power use because of a loss higher than 0.5 dB (approximately a loss of 10%).

SUMMARY

In an embodiment, the present invention provides a balun. The balun includes a substrate, a balanced port, and an unbalanced port. The substrate includes a first configuration surface and a second configuration surface opposite to the first configuration surface. The balanced port is disposed on the first configuration surface. The balanced port includes a first metal configuration section, a second metal configuration section, a first balanced terminal, and a second balanced terminal. A phase of the first balanced terminal is opposite to a phase of the second balanced terminal. The first balanced terminal is disposed at one end of the first metal configuration section. The second balanced terminal is disposed at one end of the second metal configuration section. The unbalanced port is relatively disposed on the second configuration surface corresponding to an arrangement of the balanced port to form an overlapping coupling with the balanced port. The unbalanced port includes a third metal configuration section and an unbalanced terminal. The unbalanced terminal is disposed at one end of the third metal configuration section. A first orthographic projection on the substrate formed by the first metal configuration section and the second metal configuration section jointly is overlapped with a second orthographic projection on the substrate formed by the third metal configuration section to form an overlapping coupling.

In summary, in the balun according to the embodiments of the present invention, the balanced port and the unbalanced port are disposed corresponding to each other on the two configuration surfaces of the substrate to form the overlapping coupling, thereby greatly improving coupling efficiency and reducing a coupling energy loss. In addition, because the balun according to an embodiment of the present invention has features such as planarization (for example, through a printed circuit board), miniaturization (for example, a quarter wavelength of an application frequency and/or a design of a ring shape), and a high degree of balance (a nearly perfect differential signal), and a low loss (for example, passing 500 MHz 1000 watts of radio frequency power for a long time without overheating), the balun is applicable to applications that need to use high-power radio frequency circuits or small-signal, low-loss product applications, and has advantages, such as high specifications, low production costs, a small volume, and good performance, that are in line with considerations of commercial or scientific research products.

The features and advantages of the present invention are described in detail in the following implementations, and the content thereof is sufficient for any person skilled in the art to understand the technical content of the present invention and implement it accordingly. In addition, according to the content disclosed in this specification, the claims and the drawings, any person skilled in the art can easily understand the relevant objectives and advantages of the present invention.

DETAILED DESCRIPTION

To make the foregoing objectives, features, and advantages of embodiments of the present invention more obvious and comprehensible, detailed descriptions are provided below with reference to the accompanying drawings.

Referring to FIG. 1 to FIG. 7, a balun 100 according to any embodiment of the present invention may be configured to receive a single-ended radio frequency signal and convert the single-ended radio frequency signal into a double-ended differential radio frequency signal, or receive a double-ended differential radio frequency signal, and convert the double-ended radio frequency signal into a single-ended radio frequency signal. In addition, the balun 100 according to any embodiment of the present invention also has an impedance transformation function.

Figure 2:
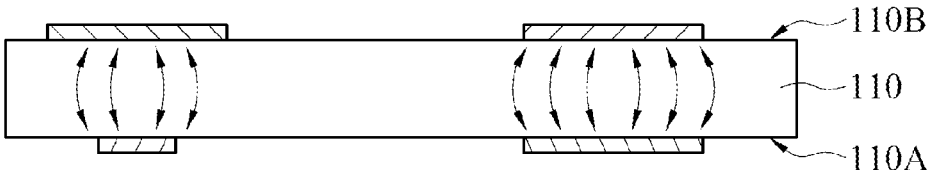
FIG. 2 is a schematic diagram of configuration widths of a metal configuration section on two configuration surfaces of a substrate.

The balun 100 includes a substrate 110, a balanced port 120, and an unbalanced port 130. As shown in FIG. 2, the substrate 110 may have two configuration surfaces (hereinafter respectively referred to as a first configuration surface 110A and a second configuration surface 110B) opposite to each other. Both the first configuration surface 110A and the second configuration surface 110B of the substrate 110 may be used for configuration of electronic circuits, electronic parts, and the like thereon. In any embodiment of the present invention, the balanced port 120 is disposed on the first configuration surface 110A, and the unbalanced port 130 may be relatively disposed on the second configuration surface 110B corresponding to an arrangement of the balanced port 120 to form an overlapping coupling with the balanced port 120. Through the overlapping coupling, coupling efficiency of the balun 100 according to any embodiment of the present invention can be greatly improved, and an energy loss during the coupling can be reduced. Therefore, the balun 100 according to any embodiment of the present invention is applicable to applications that need to use high-power radio frequency circuits, including, for example, a base station amplifier, a radar amplifier, a plasma machine, microwave heating, nuclear magnetic resonance imaging (MRI), and an accelerator. Alternatively, the balun 100 may be applied to small-signal, low-loss product applications, for example, a communication circuit, a mixer, and a down converter.

The balanced port 120 includes a first metal configuration section 121, a second metal configuration section 122, and two balanced terminals (hereinafter respectively referred to as a first balanced terminal B1 and a second balanced terminal B2). The first balanced terminal B1 is disposed at one end of the first metal configuration section 121, and the second balanced terminal B2 is disposed at one end of the second metal configuration section 122. In this case, a phase of a signal outputted (or received) by the first balanced terminal B1 is opposite to a phase of a signal outputted (or received) by the second balanced terminal B2. In other words, the phase of the first balanced terminal B1 differs from the phase of the second balanced terminal B2 by 180 degrees.

The unbalanced port 130 includes a third metal configuration section 131 and an unbalanced terminal U1, and the unbalanced terminal U1 is disposed at one end of the third metal configuration section 131. In this case, the third metal configuration section 131 of the unbalanced port 130 may be relatively arranged corresponding to an arrangement of the first metal configuration section 121 and the second metal configuration section 122 of the balanced port 120. In this case, a first orthographic projection on the substrate 110 formed by the first metal configuration section 121 and the second metal configuration section 122 of the balanced port 120 jointly is overlapped with a second orthographic projection on the substrate 110 formed by the third metal configuration section 131 of the unbalanced port 130, so that an overlapping coupling may be formed between the third metal configuration section 131 and the second metal configuration section 122 and between the first metal configuration section 121 and the second metal configuration section 122

In some embodiments, either of the first orthographic projection and the second orthographic projection may completely cover the other. In other words, a configuration width of a metal configuration section (the first metal configuration section 121 or the second metal configuration section 122) on the first configuration surface 110A may be different from a configuration width of a metal configuration section (the third metal configuration section 131) on the second configuration surface 110B, but a metal configuration section with a smaller configuration width needs to be completely covered by a metal configuration section with a larger configuration width. As shown in the left half of FIG. 2, an example in which a configuration width of a metal configuration section on the second configuration surface 110B is greater than that of a metal configuration section on the first configuration surface 110A is used herein. It should be noted that in the present invention, it is not limited that a configuration width of a metal configuration section on the first configuration surface 110A is different from a configuration width of a metal configuration section on the second configuration surface 110B. A configuration width of a metal configuration section on the first configuration surface 110A may be the same as a configuration width of a metal configuration section on the second configuration surface 110B, as shown in the right half of FIG. 2.

In some implementations, configuration widths of the first metal configuration section 121, the second metal configuration section 122, and the third metal configuration section 131 may range from approximately 3 millimeters (mm) to 10 mm.

In some embodiments, due to an overlapping coupling relationship, a length L3 of the third metal configuration section 131 of the unbalanced port 130 may be a quarter wavelength of the application frequency of the balun 100. In addition, a length L1 of the first metal configuration section 121 and a length L2 of the second metal configuration section 122 of the balanced port 120 may be one-eighth wavelength of the application frequency of the balun 100. In this case, an area of a circuit that the balun 100 needs to occupy may be greatly reduced.

Figure 3:
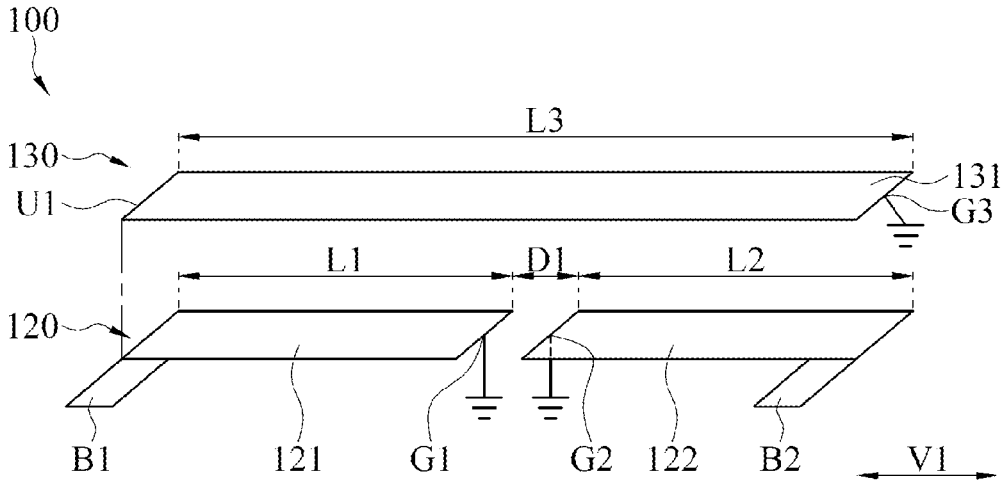
FIG. 3 is a schematic diagram of an embodiment of a balun according to the present invention.

In some embodiments, as shown in any one of FIG. 1, FIG. 4, FIG. 5, or FIG. 7, the first balanced terminal B1 of the balanced port 120 may be adjacent to the second balanced terminal B2, and the first balanced terminal B1 and the second balanced terminal B2 are spaced at a first distance D1. In other words, an end of the first metal configuration section 121 on which the first balanced terminal B1 is disposed may be adjacent to an end of the second metal configuration section 122 on which the second balanced terminal B2 is disposed at a distance of the first distance D1. In some implementations, the first distance D1 may be approximately 2 millimeters (mm). However, the present invention is not limited to this. In other embodiments, the first balanced terminal B1 of the balanced port 120 may be far away from the second balanced terminal B2, and in this case, the balanced port 120 is adjacent to the other end of the first metal configuration section 121 on which the first balanced terminal B1 is not disposed and the other end of the second metal configuration section 122 on which the second balanced terminal B2 is not disposed, as shown in FIG. 3.

In some embodiments, the balanced port 120 may further include a first ground terminal G1 and a second ground terminal G2. The first ground terminal G1 is disposed the other end of the first metal configuration section 121, and the second ground terminal G2 is disposed the other end of the second metal configuration section 122. In other words, the first balanced terminal B1 is disposed at one end of the first metal configuration section 121, and the first ground terminal G1 is disposed at the other end of the first metal configuration section 121. The second balanced terminal B2 is disposed at one end of the second metal configuration section 122, and the second ground terminal G2 is disposed at the other end of the second metal configuration section 122.

In some embodiments, the first ground terminal G1 and the second ground terminal G2 may be common-grounded. For example, the other end of the first metal configuration section 121 and the other end of the second metal configuration section 122 may be directly connected, and be electrically connected to the same ground together, as shown in FIG. 4 to FIG. 7. In other words, in this case, the first metal configuration section 121 and the second metal configuration section 122 may be the same metal configuration section 123, and the first ground terminal G1 and the second ground terminal G2 may be at a common point at the center of the metal configuration section 123 to be electrically connected to a ground together. However, the present invention is not limited to this. The first metal configuration section 121 and the second metal configuration section 122 may alternatively be two separate metal configuration sections, as shown in FIG. 3, and the other end of the first metal configuration section 121 and the other end of the second metal configuration section 122 are electrically connected to the same ground through other electrical connection means respectively, for example, through additional connection cables.

Figure 1:
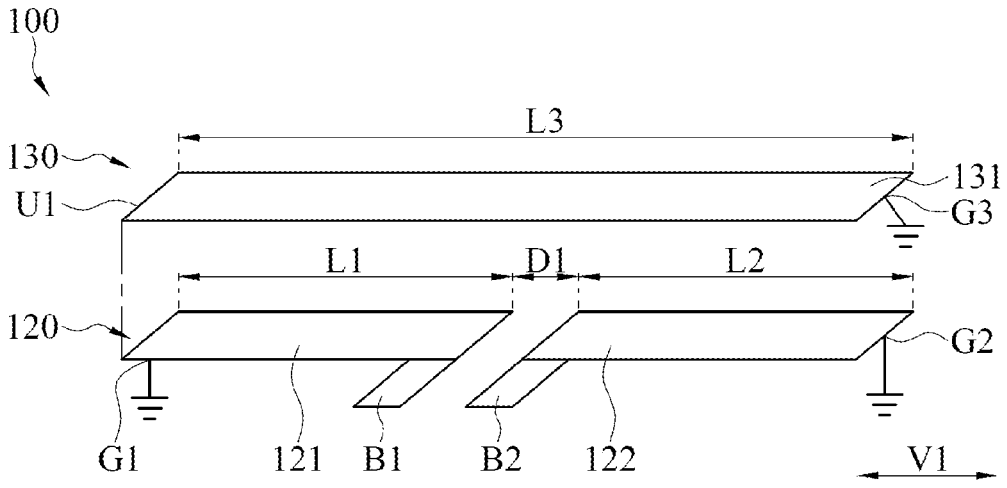
FIG. 1 is a schematic diagram of an embodiment of a balun according to the present invention.

In some embodiments, as shown in FIG. 1 and FIG. 2, the first metal configuration section 121 and the second metal configuration section 122 of the balanced port 120 may be in a shape of a long strip, and the third metal configuration section 131 of the unbalanced port 130 is also in a shape of a long strip.

For example, in an implementation, the first metal configuration section 121 with a length L1 of one-eighth wavelength of the application frequency may extend along a horizontal direction V1 and be disposed on the first configuration surface 110A of the substrate 110. The second metal configuration section 122 with a length L2 of one-eighth wavelength of the application frequency may extend along the horizontal direction V1 starting at a first distance D1 from the end of the first metal configuration section 121 and is disposed on the first configuration surface 110A of the substrate 110. The third metal configuration section 131 with a length L3 of a quarter wavelength of the application frequency extends along the horizontal direction V1 and is relatively disposed, corresponding to an arrangement of the first metal configuration section 121 and the second metal configuration section 122, on the second configuration surface 110B of the substrate 110. In this case, as shown in FIG. 1, the first balanced terminal B1 and the second balanced terminal B2 may be pulled out from a central side (that is, two adjacent ends of the first metal configuration section 121 and the second metal configuration section 122), and the first ground terminal G1 and the second ground terminal G2 are located on two outer sides and short-circuited to a ground (that is, the other end of the first metal configuration section 121 and the other end of the second metal configuration section 122). In addition, the unbalanced terminal U1 may be located at the left end of the third metal configuration section 131, and the third ground terminal G3 is located at the right end of the third metal configuration section 131. However, the present invention is not limited to this. In another implementation, positions of the first balanced terminal B1 and the second balanced terminal B2 may be selected more flexibly. Therefore, an arrangement position of the first balanced terminal B1 in the balanced port 120 may be exchanged with that of the first ground terminal G1, and an arrangement position of the second balanced terminal B2 may be exchanged with that of the second ground terminal G2, so that the first ground terminal G1 and the second ground terminal G2 are changed to be located on the central side, while the first balanced terminal B1 and the second balanced terminal B2 are located on the two outer sides, as shown in FIG. 3. In addition, in still another embodiment, the first metal configuration section 121 and the second metal configuration section 122 of the balanced port 120 may be implemented as the same metal configuration section, for example, a metal configuration section with a length of a quarter wavelength of the application frequency, and the first ground terminal G1 and the second ground terminal G2 are located at the central side of the metal configuration section and are electrically connected to the same ground.

In some embodiments, as shown in FIG. 4 to FIG. 7, the first metal configuration section 121 and the second metal configuration section 122 of the balanced port 120 may be in a shape of a ring jointly, and the third metal configuration section 131 of the unbalanced port 130 is also in a shape of a ring. In some embodiments, the ring may include, but is not limited to, a circular ring, a square ring, a triangular ring, or an octagonal ring. Other applicable types of rings may also be applied to the balun 100 of the present invention. In particular, layout space of a circuit can be optimized by adjusting the shape of the ring, to effectively reduce mass production costs. Configuration in a shape of a circular ring can make the area of a circuit occupied by the balun 100 smaller.

Figure 4:
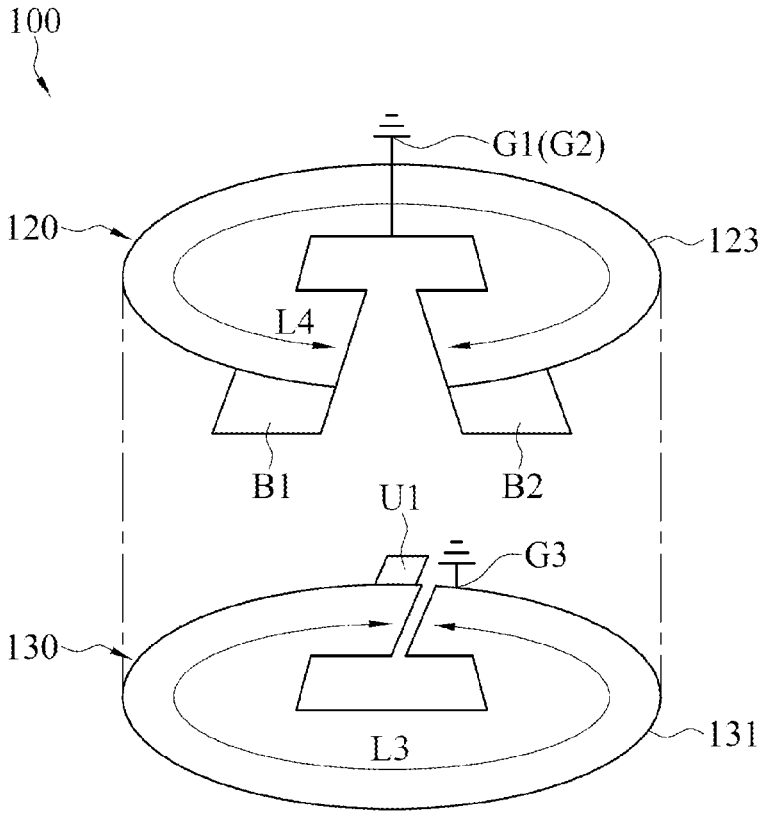
FIG. 4 is a schematic diagram of an embodiment of a balun according to the present invention.
Figure 5:
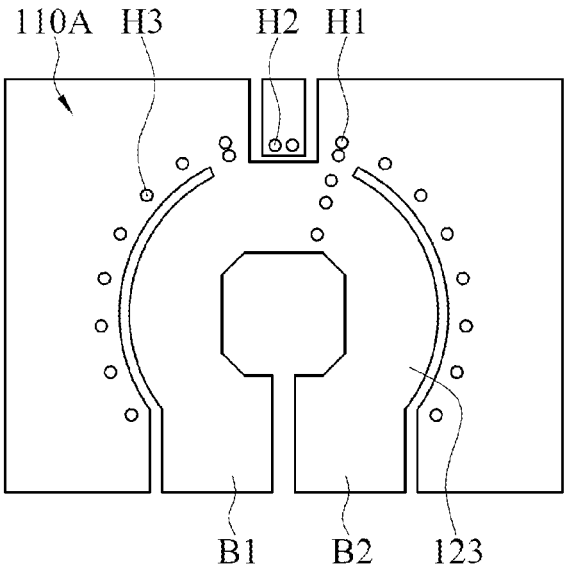
FIG. 5 is a schematic diagram of an implementation of a balanced port in FIG. 4.
Figure 6:
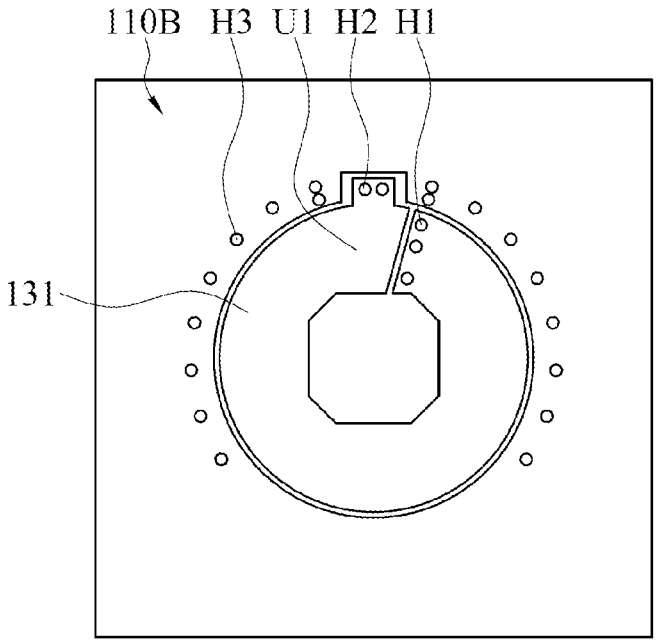
FIG. 6 is a schematic diagram of an implementation of an unbalanced port in FIG. 4.
Figure 7:
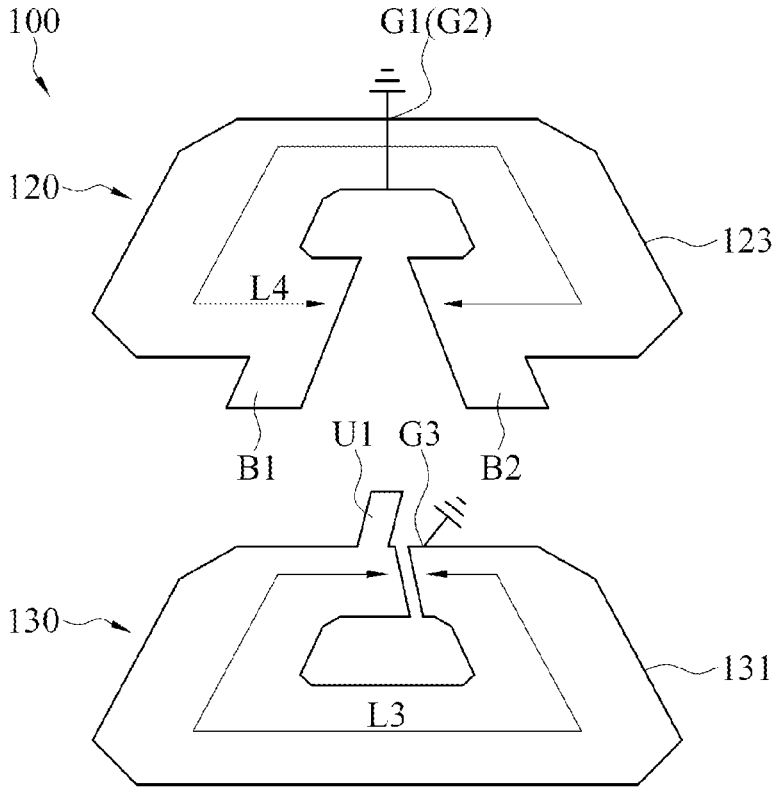
FIG. 7 is a schematic diagram of an embodiment of a balun according to the present invention.

The following will be explained by using the shape of a circular ring. In an implementation, as shown in FIG. 4 to FIG. 6, the first metal configuration section 121 and the second metal configuration section 122 may be implemented as the same metal configuration section 123, for example, the metal configuration section 123 with a length L4 of a quarter wavelength of the application frequency, and the metal configuration section 123 is wound into a circle on the first configuration surface 110A of the substrate 110. The third metal configuration section 131 with a length L3 of a quarter wavelength of the application frequency is also relatively wound into a circle on the second configuration surface 110B of the substrate 110 corresponding to an arrangement of the location where the first metal configuration section 121 and the second metal configuration section 122. In this case, the first balanced terminal B1 and the second balanced terminal B2 may be pulled out from two ends of the metal configuration section 123 respectively, and are adjacent to each other due to being wound into a ring. The first ground terminal G1 and the second ground terminal G2 are located at the central side of the metal configuration section 123, for example, at a distance of approximately one-eighth wavelength of the application frequency from an end, and are electrically connected to the same ground together. In addition, the unbalanced terminal U1 may be located at the left end of the third metal configuration section 131, and the third ground terminal G3 is located at the right end of the third metal configuration section 131. In particular, as shown in FIG. 5 and FIG. 6, the right end of the third metal configuration section 131 (that is, the third ground terminal G3) may be relatively disposed corresponding to arrangement positions of the first ground terminal G1 and the second ground terminal G2, so that the third ground terminal G3 on the second configuration surface 110B may be directly electrically connected to the first ground terminal G1 and the second ground terminal G2 on the first configuration surface 110A, through a conductive via H1 penetrating through the substrate 110, to be common grounded. In this case, the area of a circuit that the balun 100 needs to occupy may be further saved. In addition, to facilitate circuit configuration, the unbalanced terminal U1 originally located on the second configuration surface 110B of the substrate 110 may be changed to be disposed on the first configuration surface 110A of the substrate 110 through an electrical connection of a conductive via H2.

However, the present invention is not limited to this. In another implementation, the first metal configuration section 121 with a length L1 of one-eighth wavelength of the application frequency may be wound into a semicircle on the first configuration surface 110A of the substrate 110. The second metal configuration section 122 with a length L2 of one-eighth wavelength of the application frequency may be spaced from the first metal configuration section 121 and wound into the other semicircle on the first configuration surface 110A of the substrate 110. The first metal configuration section 121 and the second metal configuration section 122 may substantially form a circular ring jointly. In this case, the first ground terminal G1 and the second ground terminal G2 may be electrically connected to different grounds respectively, or may be electrically connected to the same ground through additional connection cables and the like.

In some embodiments, the balun 100 may further include a plurality of conductive vias H3 penetrating through the substrate 110. As shown in FIG. 5 and FIG. 6, the conductive vias H3 may be adjacent to the balanced port 120 and the unbalanced port 130 and provided in the substrate 110, and the conductive vias H3 may be electrically connected to a ground. In this case, the conductive vias H3 may be used to increase heat dissipation paths to assist dissipating heat.

In some embodiments, the substrate 110 may be a printed circuit board, and the balun 100 may be printed on the printed circuit board through printed circuit fabrication. In other words, the first metal configuration section 121 and the second metal configuration section 122 of the balanced port 120 and the third metal configuration section 131 of the unbalanced port 130 may be printed circuit lines, so that the balun 100 may be planarized to minimize the space, and the production thereof becomes easier.

In particular, the balun 100 according to an embodiment of the present invention may reach up to 500 megahertz (MHz) and 1000 watts (W) after verification, and has a loss of less than 0.05 dB. In addition, an amplitude difference between the two balanced terminals may be less than 0.5 dB, and a phase difference therebetween may even be less than 1 degree, so that a high degree of balance is achieved. According to an embodiment of the present invention, because a loss of the balun 100 is extremely low, a main loss may depend on a loss of a material of the substrate 110. In other words, choosing a better material may further reduce the loss. For example, a material with a dielectric loss below 0.002 may be selected for implementation.

In summary, in the balun according to the embodiments of the present invention, the balanced port and the unbalanced port are disposed corresponding to each other on the two configuration surfaces of the substrate to form the overlapping coupling, thereby greatly improving coupling efficiency and reducing a coupling energy loss. In addition, because the balun according to an embodiment of the present invention has features such as planarization (for example, through a printed circuit board), miniaturization (for example, a quarter wavelength of an application frequency and/or a design of a ring shape), and a high degree of balance (a nearly perfect differential signal), and a low loss (for example, passing 500 MHz 1000 watts of radio frequency power for a long time without overheating), the balun is applicable to applications that need to use high-power radio frequency circuits or small-signal, low-loss product applications, and has advantages, such as high specifications, low production costs, a small volume, and good performance, that are in line with considerations of commercial or scientific research products.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A balun, comprising:

a substrate, comprising a first configuration surface and a second configuration surface opposite to the first configuration surface;

a balanced port, disposed on the first configuration surface, wherein the balanced port comprises a first metal configuration section, a second metal configuration section, a first balanced terminal, and a second balanced terminal, a phase of the first balanced terminal is opposite to a phase of the second balanced terminal, the first balanced terminal is disposed at one end of the first metal configuration section, and the second balanced terminal is disposed at one end of the second metal configuration section; and an unbalanced port, relatively disposed on the second configuration surface corresponding to an arrangement of the balanced port to form an overlapping coupling with the balanced port, wherein the unbalanced port comprises a third metal configuration section and an unbalanced terminal, the unbalanced terminal is disposed at one end of the third metal configuration section, and a first orthographic projection on the substrate formed by the first metal configuration section and the second metal configuration section jointly is overlapped with a second orthographic projection on the substrate formed by the third metal configuration section.

2. The balun according to claim 1, wherein the balanced port further comprises a first ground terminal and a second ground terminal, the first ground terminal is disposed the other end of the first metal configuration section, the second ground terminal is disposed the other end of the second metal configuration section, and the first ground terminal and the second ground terminal are common-grounded.

3. The balun according to claim 1, wherein a length of the third metal configuration section is a quarter wavelength of an application frequency.

4. The balun according to claim 1, wherein a length of the first metal configuration section and a length of the second metal configuration section are one-eighth wavelength of an application frequency.

5. The balun according to claim 1, wherein either of the first orthographic projection and the second orthographic projection completely covers the other.

6. The balun according to claim 1, wherein the first balanced terminal is adjacent to the second balanced terminal, and the first balanced terminal and the second balanced terminal are spaced at a first distance.

7. The balun according to claim 1, wherein the first metal configuration section, the second metal configuration section, and the third metal configuration section are all in a shape of a long strip.

8. The balun according to claim 1, wherein the third metal configuration section is in a shape of a ring, and the first metal configuration section and the second metal configuration section jointly form the shape of the ring.

9. The balun according to claim 8, wherein the ring is a circular ring, a square ring, a triangular ring, or an octagonal ring.

10. The balun according to claim 1, further comprising a plurality of conductive vias, wherein the conductive vias are adjacent to the balanced port and the unbalanced port, are provided in the substrate, and are grounded.

* * * * *